United States Patent [19]

Inoue et al.

[11] Patent Number: 4,997,395

[45] Date of Patent: Mar. 5, 1991

[54] WATER-PROOF CONNECTOR

[75] Inventors: Hirotoshi Inoue, Saitama; Masakuni Kasugai, Mie, both of Japan

[73] Assignees: Honda Giken Kogyo K.K., Tokyo; Sumitomo Wiring System, Ltd., Yokkaichi, both of Japan

[21] Appl. No.: 466,606

[22] Filed: Jan. 17, 1990

[51] Int. Cl.[5] ..... H01R 13/426; H01R 12/432

[52] U.S. Cl. ..... 439/752; 439/488

[58] Field of Search ..... 439/488, 589, 595, 752, 439/794, 796

[56] References Cited

U.S. PATENT DOCUMENTS 4,433,888 2/1984 Winger ..... 339/91 R
4,621,883 11/1986 Noguchi ..... 439/752 X
4,772,229 9/1988 Nix et al. ..... 439/752 X
4,921,437 5/1990 Cooper et al. ..... 439/595 X
4,936,798 6/1990 Hass et al. ..... 439/752

*Primary Examiner*—Eugene F. Desmond
*Attorney, Agent, or Firm*—Wenderoth, Lind & Ponack

[57] ABSTRACT

Water proofing of a water-proof connector is achieved in such a manner that terminals (3) are inserted into a connector housing (1), the terminals (3) are locked inside the housing (1) by means of a retainer (9), and a rubber plug (5) is press fitted in the housing (1). At this time, a detection pin (10) of the retainer (9) is caused to be inserted in a hole (21) of the rubber plug (5), and the distal end of the pin (10) slightly projects from the hole (21). This allows one to see that the terminals (3) are properly received in the housing (1).

3 Claims, 3 Drawing Sheets

WATER-PROOF CONNECTOR

BACKGROUND OF THE INVENTION

The present invention relates to a water-proof connector in which water proofing is achieved by press fitting in the inner periphery of a connector housing a rubber plug through which wires are put after the terminals of the wires have been connected to the connector housing, and more particularly to the locking structure of terminals to be connected to the water-proof connector.

One of such conventional locking structures of terminals to be connected to water-proof connectors is a double-locking structure which comprises a primary locking mechanism in which the lances of terminals when inserted are locked at a locking portion provided in terminal receiving cavities and a secondary locking mechanism in which a separate retainer is fitted in either from the front or rear side of the inserted terminals so as to prevent the terminals from coming off.

However, in a locking structure having such a secondary locking mechanism in which a retainer is fitted in from the rear side of the terminals to press against the rubber plug behind the terminals, if the terminals are inserted improperly they may not be pushed forward sufficiently to be located at a normal position, and imperfect insertion is thus likely to take place wherein the action of the primary locking mechanism cannot be expected to function. In contrast, in the case of a secondary locking mechanism in which the retainer is fitted in from the front side of the terminals, the retainer is easily fitted in, even if the terminals are inserted improperly, and this often makes it impossible to detect an error of imperfect insertion of the terminals. Thus, the action of the double-locking structure for the terminals often cannot be expected to function in either of the above cases.

SUMMARY OF THE INVENTION

An object of the present invention is to provide a water-proof connector capable of solving the above-mentioned problems which are inherent to the conventional techniques.

To meet this end, a water-proof connector according to the present invention is constructed so as to realize a water-proof connector having a primary locking mechanism for terminals to be connected to the connector in which the lances of the terminals are locked at locking portions provided in a connector housing and a rubber plug adapted to fit therein from the rear side of the terminals to thereby achieve water proofing, and characterized in that a retainer is provided between the terminals and the rubber plug to be locked at a predetermined position therebetween, the retainer having a spacer portion provided thereon so as to form a secondary locking mechanism in such a manner as to project forward and adapted to engage the locking portions of the terminals when fitted in above the terminals and a detection pin provided thereon in such a manner as to project rearward through a hole provided in the rubber plug to allow the detection pin to be put through when the plug is fitted in properly.

With a water-proof connector as constructed according to the present invention, the terminals in the connector housing are designed to be pushed forward twice, respectively, by the retainer and rubber plug which are fitted in from the rear side thereof, the possibility of the terminals being inadequately inserted thus being securely prevented. In addition, the detection pin adapted to project rearward from the rubber plug allows visual confirmation as to whether or not the retainer is properly fitted in.

BRIEF DESCRIPTION OF THE DRAWINGS

The objects and attendant advantages of the present invention will be more readily apparent to those skilled in the art from a reading of the following detailed description of a preferred embodiment of the present invention in conjunction with the accompanying drawings in which.

A preferred embodiment of the water-proof connector according to the present invention will now be described with respect to the accompanying drawings.

DETAILED DESCRIPTION OF THE INVENTION

Figure 1:
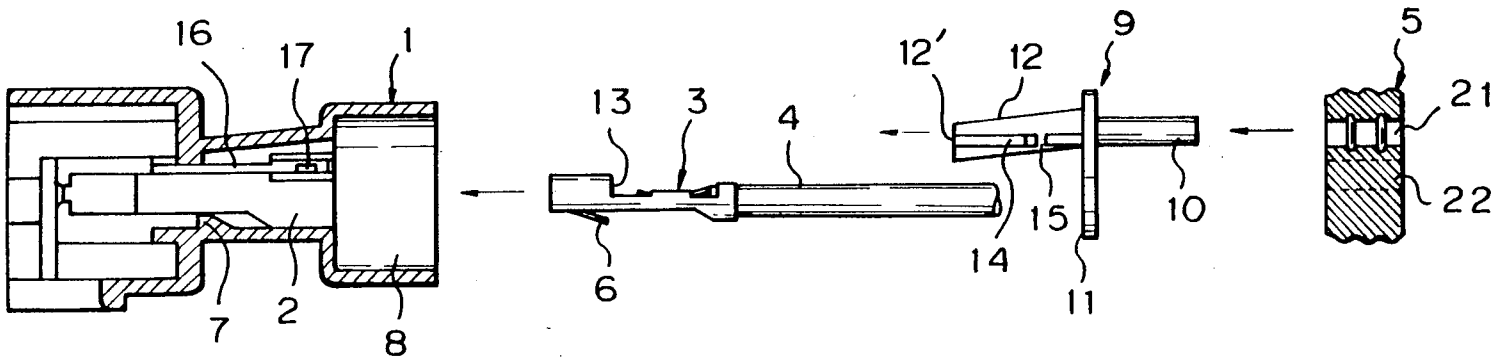
FIG. 1 is an exploded side view showing a water-proof connector as one embodiment of the present invention.
Figure 2:
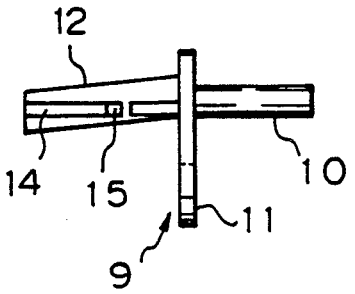
FIG. 2 is a side view of a retainer for the embodiment shown in FIG. 1.
Figure 3:
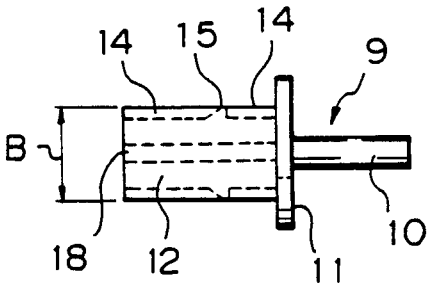
FIG. 3 is a plan view of the retainer shown in FIG. 2.
Figure 4:
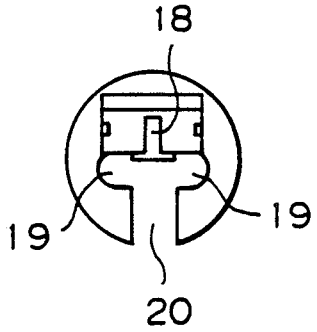
FIG. 4 is an end view of the retainer shown in FIG. 2 as viewed from the left-hand side thereof.
Figure 5:
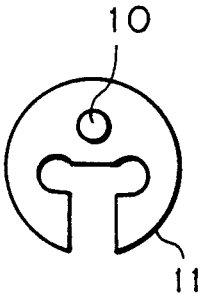
FIG. 5 is an end view of the retainer shown in FIG. 2 as viewed from the right-hand side thereof.

Referring to FIG. 1, a water-proof connector according to the present invention has a primary locking mechanism in which, when terminals 3 of wires 4 are fitted in terminal receiving cavities 2 provided in a connector housing 1, lances 6 of the terminals 3 are locked at locking portions 7 provided in the terminal receiving cavities 2 and a rubber plug 5 is adapted to fit in from the rear side of the terminals 3 which are inserted and locked in place. In addition, a retainer 9 is provided between the terminals 3 and the rubber plug 5 to secondarily lock the terminals 3 in place, and the retainer 9 has a detection pin 10 adapted to project rearward through the rubber plug 5 when the retainer 9 and the rubber plug 5 are properly fitted to each other.

More particularly, the connector housing 1 according to the present invention is of a bipolar type. As shown in FIGS. 2 to 5, the retainer 9 has a spacer portion 12 having width B and provided in such a way as to project forward from a flange portion 11 thereof so as to fit in two bipolar-type cavities 2 for the terminals when inserted. When the retainer 9 is fitted in a rubber plug receiving cavity 8 in the connector housing 1 with the spacer portion 12 thereof being received in the terminal receiving cavities 2, the flange portion 11 of the retainer 9 comes into abutment with the front end of the rubber plug receiving cavity 8 to define a proper connecting position. In this condition, the spacer portion 12 is positioned above the terminals 3 in the terminal receiving cavities 2, and the distal end 12' of the spacer portion 12 comes into abutment with the locking portions 13 of the terminals 3 from the rear side thereof, a secondary locking mechanism thus being formed to prevent the terminals 3 from being drawn back.

Guide grooves 14 are provided in the spacer portion 12 of the retainer 9 lengthwise along the edges thereof, and a locking projection 15 is formed in the middle of each groove 14. The guide grooves 14 are adapted to fit on the guide portions 16 of the terminal receiving cavities 2 and slide thereover when the spacer portion 12 is fitted in the same cavities 2, and locking pawls 17 of the guide portions 16 and the locking projections 15 are brought into engagement with each other when the retainer 9 is inserted to a final position, the retainer 9 thus being designed to be prevented from being drawn back and securely locked in place.

In addition, since the retainer 9 is inserted into the two parallel terminal receiving cavities 2, a guide groove 18 is provided on the bottom surface of the spacer portion 12 for engagement with the upper edge of a bulkhead for the two terminal receiving cavities 2 when inserted. A nick 20 is provided in the flange portion 11 to allow the wires 4 to be put through when the retainer 9 is mounted on the wires, and also provided therein in such a way as to be continuous with the nick 20 are two holes 19 through which the wires 4 are allowed to extend. The detection pin 10 is made slightly longer (by 2 to 3 millimeters) than the thickness W (FIG. 6) of the rubber plug 5.

Figure 6:
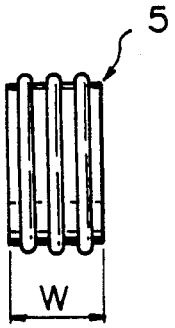
FIG. 6 shows a rubber plug for the embodiment shown in FIG. 1.
Figure 7:
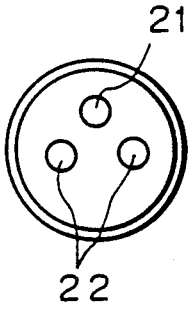
FIG. 7 is an end view of the rubber plug shown in FIG. 6.

As shown in FIGS. 6 and 7, in the rubber plug 5, a hole 21 through which the detection pin 10 is allowed to extend is provided at a position horizontally in the middle and vertically closer to the upper peripheral portion thereof and holes 22 through which the wires 4 are allowed to extend are provided in a parallel manner at the center thereof. These holes 21 and 22 are adapted to allow the detection pin 10 and the wires 4 to extend therethrough in a water-tight manner.

Figure 8:
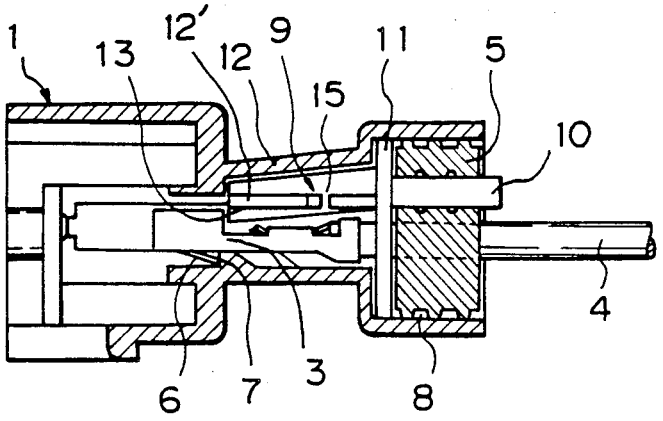
FIG. 8 is a longitudinal sectional view showing a condition wherein the water-proof connector of the embodiment is being used.

In utilization of the water-proof connector described above, as shown in FIG. 8, the terminals 3 are first inserted into the terminal receiving cavities 2, and the lances 6 and the locking portions 7, which compose the primary locking mechanism, are brought into engagement with each other. When the retainer 9 is then fitted in the connector housing 1, the distal end 12' of the spacer portion 12 is brought into abutment with the locking portions 13 of the terminals 3 (the rear end of the enlarged contact portion of the terminal 3 is adapted to serve as a locking portion 13 in this embodiment), thus making it possible to work the secondary locking mechanism so as to prevent the terminals 3 from coming off. Next to this, the locking projections 15 of the retainer 9 are brought into engagement with the locking pawls 17 in the terminal receiving cavities 2. Thus, the retainer 9 is properly fitted in and locked in place. Finally, the rubber plug 5, which is mounted on the wires 4 in advance, is fitted in the rubber plug receiving cavity 8 in such a manner that the detection pin 10 projects slightly from the rear surface of the rubber plug 5, and is fixed there.

As is described above, the water-proof connector according to the present invention is characterized by having a construction wherein the retainer 9 is interposed between the terminals 3 and the rubber plug 5 in such a manner that the detection pin 10 thereof projects from the rubber plug 5 fitted thereto. The terminals 3 are designed to be pushed forward twice, respectively, by the retainer 9 and the rubber plug 5. In this construction, even when an error occurs in insertion of the terminals 3 so that they are not inserted properly and adequately, the terminals 3 may thereafter be pushed forward to a normal position, the forward positional correction of the terminals 3 being thus effected. This allows the primary locking mechanism for the terminals to suitably work with the cooperation of the lances 6 and the locking portions 7. Thus, the double-locking structure of the water-proof connector is enabled to function adequately with the cooperation of the primary locking mechanism and the secondary locking mechanism which is effected by the retainer 9.

In addition, the detection pin 10 of the retainer 9 allows proper visual confirmation as to whether or not the retainer 9 has been properly fitted in place, thus making it possible to satisfactorily detect any error involving imperfect insertion of the terminals.

As is clear from what is described above, the water-proof connector according to the present invention has the advantage that the terminal insertion accuracy and terminal locking performance can be improved, thus allowing an attempt to be made to attain more stable functioning of water-proof connectors.

What is claimed is:

1. A water-proof connector having a primary locking mechanism for terminals (3) utilizing lances (6) and in which a rubber plug (5) is fitted in from the rear side of said terminals (3) so as to achieve water proofing, characterized in that a retainer (9) is mounted between said terminals (3) and rubber plug (5) to be locked in place at a predetermined position in a connector housing 1, said retainer (9) having a spacer portion (12) provided thereon so as to form a secondary locking mechanism in such a manner as to project forward and engage locking portions (13) of said terminals (3) at the distal end 12' thereof when inserted above said terminals (3), and a detection pin (10) provided thereon in such a manner as to project rearward through a hole (21) provided in said rubber plug (5) to allow said detection pin (10) to be put through when said rubber plug (5) is fitted in properly.

2. A water-proof connector according to claim 1, wherein the length of said detection pin (10) is made slightly greater than the width (W) of said rubber plug (5).

3. A water-proof connector according to claim 1, wherein locking projections (15) are longitudinally formed in the middle of guide grooves (14) formed in said retainer (9) along the edges thereof, said grooves (14) are fitted on guide portions (16) provided in terminal receiving cavities (2) so as to slide thereover, and locking pawls (17) of said guide portions (16) and said locking projections (15) are brought into engagement with each other when said terminals (3) are inserted to a final insertion point to thereby prevent said retainer (9) from being drawn back.

* * * * *